US006953272B2

(12) United States Patent
Hayakawa et al.

(10) Patent No.: US 6,953,272 B2
(45) Date of Patent: Oct. 11, 2005

(54) VEHICLE HEADLAMP

(75) Inventors: Michihiko Hayakawa, Shizuoka (JP); Michio Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 171 days.

(21) Appl. No.: 10/286,671

(22) Filed: Nov. 1, 2002

(65) Prior Publication Data

US 2003/0086277 A1 May 8, 2003

(30) Foreign Application Priority Data

Nov. 8, 2001 (JP) ..... P.2001-342689

(51) Int. Cl.[7] ..... F21V 7/04
(52) U.S. Cl. ..... 362/517; 362/539; 362/346
(58) Field of Search ..... 362/512–513, 362/516–517, 509, 515, 277, 296, 299, 538, 539, 350

(56) References Cited

U.S. PATENT DOCUMENTS 6,190,029 B1 * 2/2001 Taniuchi et al. ..... 362/512
6,286,985 B1 9/2001 Ohshio et al.
6,543,910 B2 * 4/2003 Taniuchi et al. ..... 362/297

* cited by examiner

*Primary Examiner*—Sandra O'Shea
*Assistant Examiner*—Guiyoung Lee
(74) *Attorney, Agent, or Firm*—Fish & Richardson P.C.

(57) ABSTRACT

A vehicle headlamp having a projector-type lamp unit that enhances a luminous intensity of a hot zone at the time of high beam irradiation is described. A first additional reflector is provided obliquely left-upward of an optical axis Ax, and a second additional reflector is provided obliquely right-downward of the optical axis Ax, between a reflector and a projection lens. An additional light distribution pattern is formed in a center area of a high beam distribution pattern by reflecting direct light, which has entered the first additional reflector from a light source, obliquely right-downward and then forward by the second additional reflector, at the time of high beam irradiation. A reflective surface of the first additional reflector is formed like an ellipsoid spherical surface having the second focus on the right side with respect to the optical axis A (the second reflector side). This makes the additional light distribution pattern into a pattern with a narrow vertical width, and enhances a luminosity of the hot zone without making a short distance area of a road surface at the front of the vehicle excessively luminous.

13 Claims, 9 Drawing Sheets

LOW BEAM

HIGH BEAM

LOW BEAM

HIGH BEAM

VEHICLE HEADLAMP

TECHNICAL FIELD

The present invention relates to a vehicle headlamp provided with a so-called projector-type lamp unit.

BACKGROUND OF THE INVENTION

A vehicle headlamp, which is configured to execute a beam switching between low beam and high beam by shifting a shade, has been previously known. For example, a vehicle headlamp including a beam switching mechanism as above driven by shifting the shade is disclosed in U.S. Pat. No. 6,286,985B1.

Although the beam switching mechanism driven by shifting the shade is employed in a so-called parabola-type lamp unit in the vehicle headlamp disclosed in the above-mentioned publication, it is also possible to employ a beam switching mechanism driven by shifting the shade in the projector-type lamp unit.

However, in the projector-type lamp unit, a light source image that forms a light distribution pattern is larger than that in the parabola-type lamp unit, due to its structural features. As a result, a luminous intensity of a hot zone (area of high-intensity light) cannot be adequately enhanced at the time of high beam irradiation, when a beam switching is executed by shifting the shade.

A detailed explanation of the problem is as follows:

FIGS. 9A and 9B show a light distribution pattern formed by beam irradiation from the lamp unit when the beam switching mechanism driven by shifting the shade is employed in the projector-type lamp unit. FIG. 9(*a*) shows a low beam distribution pattern and FIG. 9(*b*) shows a high beam distribution pattern.

In the low beam distribution pattern P(L) shown in FIG. 9(*a*), it is preferable that the luminosity of zone A in the vicinity of a cut-off line CL in an opposite lane is suppressed to or limited below a predetermined value. This is from the perspective of glare prevention for an oncoming driver. Meanwhile, in a high beam distribution pattern P(H) shown in FIG. 9(*b*), it is preferable to make zone A, as a part of the hot zone (area of high-intensity light) HZ, as luminous as possible.

Thus, contradictory requirements for lighting are made with respect to zone A, between the low beam and the high beam modes. In the projector-type lamp unit in which a light source image becomes larger, it is considerably difficult to fulfill these requirements by depending only on the absence or presence of a shade to shield the light. In this case, the luminosity of the high beam hot zone in sacrificed to some extent because priority is given to prevent glare to the oncoming driver.

SUMMARY OF THE INVENTION

The present invention was made in the view of the foregoing situations, and provides a vehicle headlamp capable of efficiently enhancing the luminosity of the hot zone at the time of high beam irradiation, while still offering glare prevention for the oncoming driver at the time of low beam irradiation. The vehicle headlamp of the invention is configured to execute forward beam irradiation in a predetermined light distribution pattern using the projector-type lamp unit.

The present invention attains the above-mentioned functions by providing two types of additional reflectors in predetermined locations.

More specifically, a vehicle headlamp according to the present invention is configured to execute forward beam irradiation in a predetermined light distribution pattern by means of a projector-type lamp unit. A light source is provided on an optical axis extending in a longitudinal direction of a vehicle, a reflector reflects light from the light source forward and toward the optical axis, a projection lens provided at the front of the reflector, and a shade provided between the projection lens and the reflector and shields a part of light reflected from the reflector. A first additional reflector which reflects direct light from the light source obliquely downward along the optical axis, is provided between the reflector located obliquely upward of the optical axis and the projection lens. A second additional reflector which reflects light reflected from the first additional reflector forward, is provided obliquely downward of the optical axis, that is, diagonally opposite to the first additional reflector. The reflective surface of the first additional reflector is formed like an ellipsoid spherical surface having a first focus in the vicinity of the light source as well as a second focus on the second additional reflector side with respect to a vertical plane including the optical axis.

Types of the "light source" are not specifically limited. For example, a discharging light portion of a discharge bulb, a filament of an incandescent bulb such as a halogen bulb, or the like can be employed.

Since the "second additional reflector" is configured to reflect light reflected from the first additional reflector forward, detailed structures including a form of the reflective surface and a size are not specifically limited. With respect to the form of the reflective surface of the second additional reflector, it is possible to employ a quadric surface (i.e. a paraboloid, an ellipsoid surface, or a hyperboloid), a free-form surface, or the like.

As shown in the above-mentioned structure, a vehicle headlamp according to the present invention is provided with a projector-type lamp unit. The vehicle headlamp includes a first additional reflector, which reflects direct light from the light source obliquely downward closer to and toward an optical axis, and a second additional reflector, which reflects light reflected from the first additional reflector forward, obliquely downward of the optical axis, that is, diagonally opposite to the first additional reflector with respect to the optical axis, between the reflector located obliquely upward of the optical axis and the projection lens. Also, a reflective surface of the first additional reflector is formed like an ellipsoid spherical surface having a first focus in the vicinity of the light source as well as a second focus on the second additional reflector side with respect to a vertical plane including the optical axis. Therefore, the following effects can be obtained.

Namely, it is possible to add a light distribution pattern (an additional light distribution pattern). The additional light distribution pattern may be formed by light reflected from the second additional reflector in addition to a basic light distribution pattern formed by light which is reflected by the reflector and passed through the projection lens. The light distribution pattern is irradiated forward from the lamp unit, by reflecting light, which is directed obliquely upward with respect to the optical axis among direct light directed obliquely front-upward from the light source, forward by the second additional reflector after reflecting the above-mentioned light obliquely downward along the optical axis by the first additional reflector.

In addition, the reflective surface of the first additional reflector is formed like an ellipsoid spherical surface having a first focus in the vicinity of the light source as well as a second focus on the second additional reflector side with respect to a vertical plane including the optical axis. Therefore, the reflective surface of the first additional reflector can converge light reflected from the first reflector to the second focus at an angle relatively close to a horizontal level, which makes a light source image entering the second additional reflector relatively horizontally rectangular. This also makes the additional light distribution pattern formed by light reflected from the second additional reflector into a pattern with a relatively narrow vertical width.

Therefore, adding the additional light distribution pattern to the basic light distribution pattern for forming a hot zone at the time of high beam irradiation enables a luminous intensity of the hot zone to be enhanced without making a short distance area of a road surface at the front of the vehicle excessively luminous by the light distribution pattern with a relatively narrow vertical width. Meanwhile, at the time of low beam irradiation, employing only the basic light distribution pattern without adding the additional light distribution pattern prevents glare from occurring with respect to an oncoming driver.

According to the present invention, in a vehicle headlamp configured to execute high beam irradiation forward in a predetermined light distribution pattern by means of the projector-type lamp unit, it is possible to efficiently enhance the luminous intensity of the hot zone at the time of high beam irradiation in addition to preventing glare at an oncoming driver.

In addition, in general, direct light from the light source is directed obliquely front-upward and is not employed for forming a light pattern distribution in the projector-type lamp unit. However, since the direct light is employed for forming the additional light distribution pattern in the present invention, the additional light distribution pattern can be formed without adversely affecting a formation of the basic light distribution pattern.

As long as the "second focus" is positioned at a second additional reflector side with respect to a vertical plane including the optical axis, the position is not specifically limited. However, setting the second focus at a position where the second focus is rotated 45 degrees or more toward the second additional reflector from vertically below the optical axis makes the light source image entering the second additional reflector adequately horizontally rectangular. In addition to this, setting the second focus at a position 20 mm distant from the optical axis in a horizontal direction allows size reduction without keeping an excessive distance from the optical axis.

Although it is aforementioned that the specific structure of the "second additional reflector" is not specifically limited, light reflected from the first additional reflector can easily be reflected and controlled by the second additional reflector, provided that the reflective surface of the second additional reflector is formed into a quadric surface having a focus in the vicinity of the second focus of the first additional reflector.

In the above-mentioned structure, a movable shade may be provided so that the shade can take a shade position where light reflected from the reflector is partly shielded, and a translucent position where the light shielding is released. The shade may also be configured so that when the shade is at the shade position, the shade shields light directed from the first additional reflector to the second additional reflector, and when the shade is at the translucent position, the shade releases the shielding of light directed from the first additional reflector to the second additional reflector. Accordingly, beam irradiation can be executed in a basic light distribution pattern at the time of low beam irradiation, and also an additional light distribution pattern can be added to the basic light distribution pattern at the time of high beam irradiation, without requiring a new mechanism.

Also, a fixed member having through-holes that pass light directed from the first additional reflector to the second additional reflector, formed in the vicinity of the second focus of the first additional reflector may be formed. A shutter piece may also be formed for blocking the through-holes when the shade is at the shade position and for opening the through-holes when the shade is at the translucent position. Accordingly it possible to shield and release the shielding of light directed from the first additional reflector to the second additional reflector with a simple structure and also to prevent a circumstance where stray light in the lamp unit enters the second additional reflector through the through-holes at the time of low beam irradiation.

When the shade is provided, as mentioned above, an actuator for driving the shade is required. Providing the actuator on a side of the optical axis with respect to the second additional reflector makes it possible to utilize a space below the optical axis effectively, which results in configuring a more compact lamp unit. The concrete structure of the "actuator" is not specifically limited and, for example, a solenoid, a step motor, or the like can be employed.

In the above-mentioned structure, it is acceptable to provide only a pair of first and the second reflectors. However, providing two pairs of the first and second reflectors on both right and left sides of the optical axis allows the formation of more luminous additional light distribution patterns, which makes it possible to efficiently enhance the luminous intensity of the hot zone at the time of high beam irradiation.

In the vehicle headlamp according to the present invention, it is also possible to employ a projector-type lamp unit as the lamp unit exclusive to low beam irradiation, and add the additional light distribution pattern formed by light reflected from the second additional reflector to the basic light distribution pattern (i.e. low beam distribution pattern) at all times or at appropriate times.

DETAILED DESCRIPTION

Hereafter, embodiments of the present invention will be described with reference to accompanying drawings.

Figure 1:
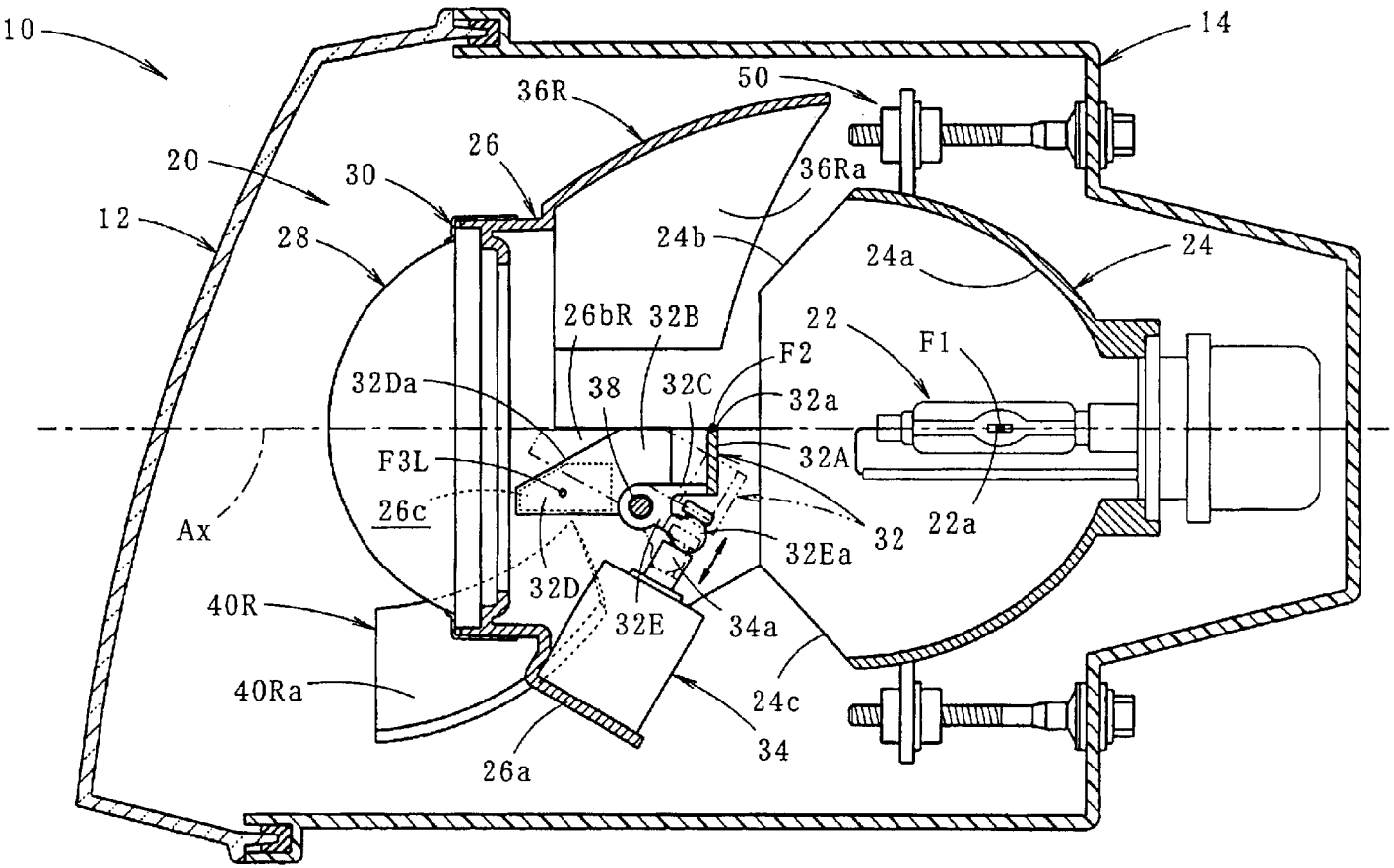
FIG. 1 is a vertical sectional view showing a vehicle headlamp according to an embodiment of the present invention.

FIG. 1 is a vertical sectional view showing a vehicle headlamp according to an embodiment of the present invention.

As shown in the figure, a vehicle headlamp 10 includes a lamp body 14 and translucent cover 12. A lamp unit 20 is tiltable in the vertical and lateral directions through an aiming mechanism 50, in a lamp room formed by the translucent cover 12 and the lamp body 14.

Figure 2:
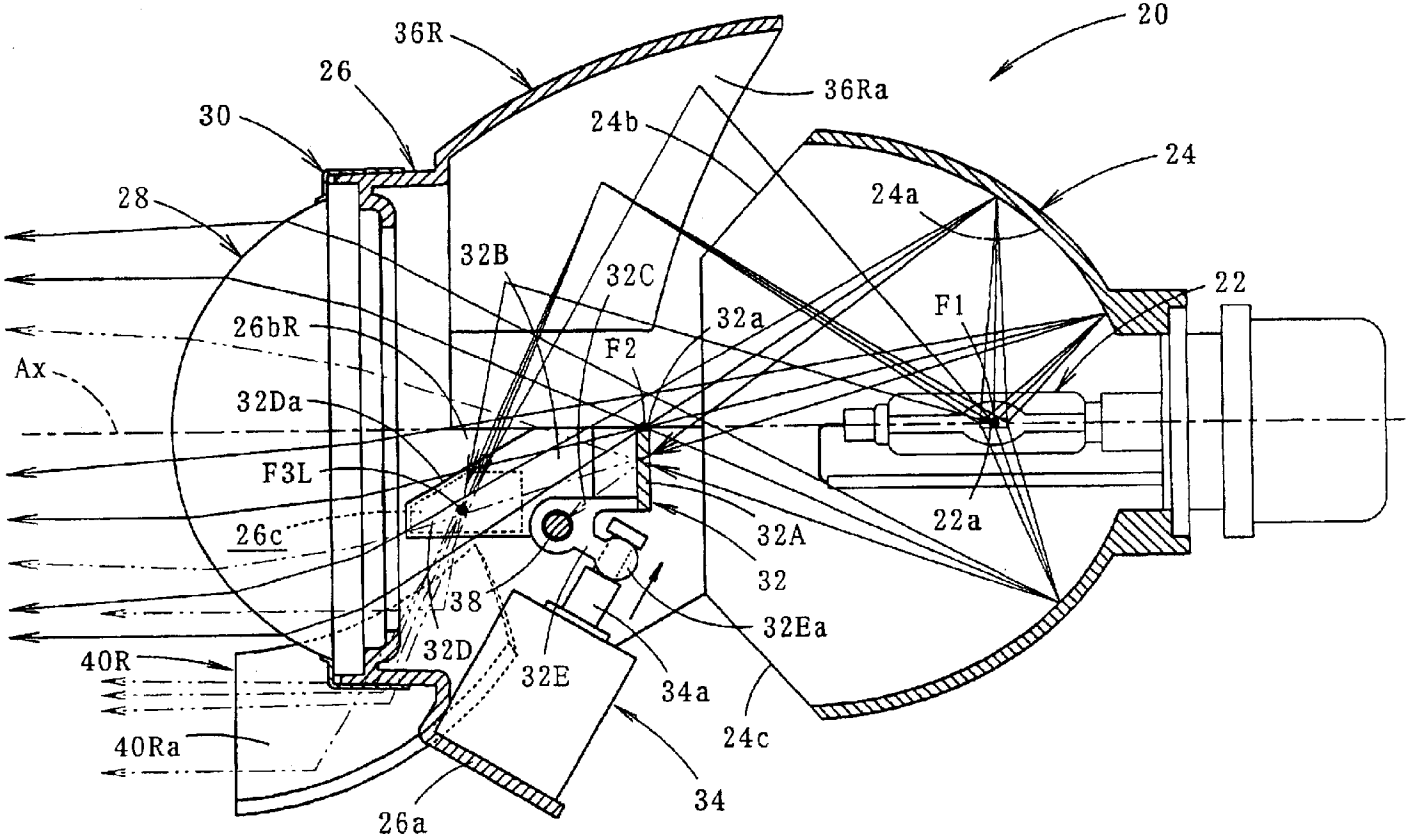
FIG. 2 is a vertical sectional view showing details of the lamp unit of the vehicle headlamp of FIG. 1.
Figure 3:
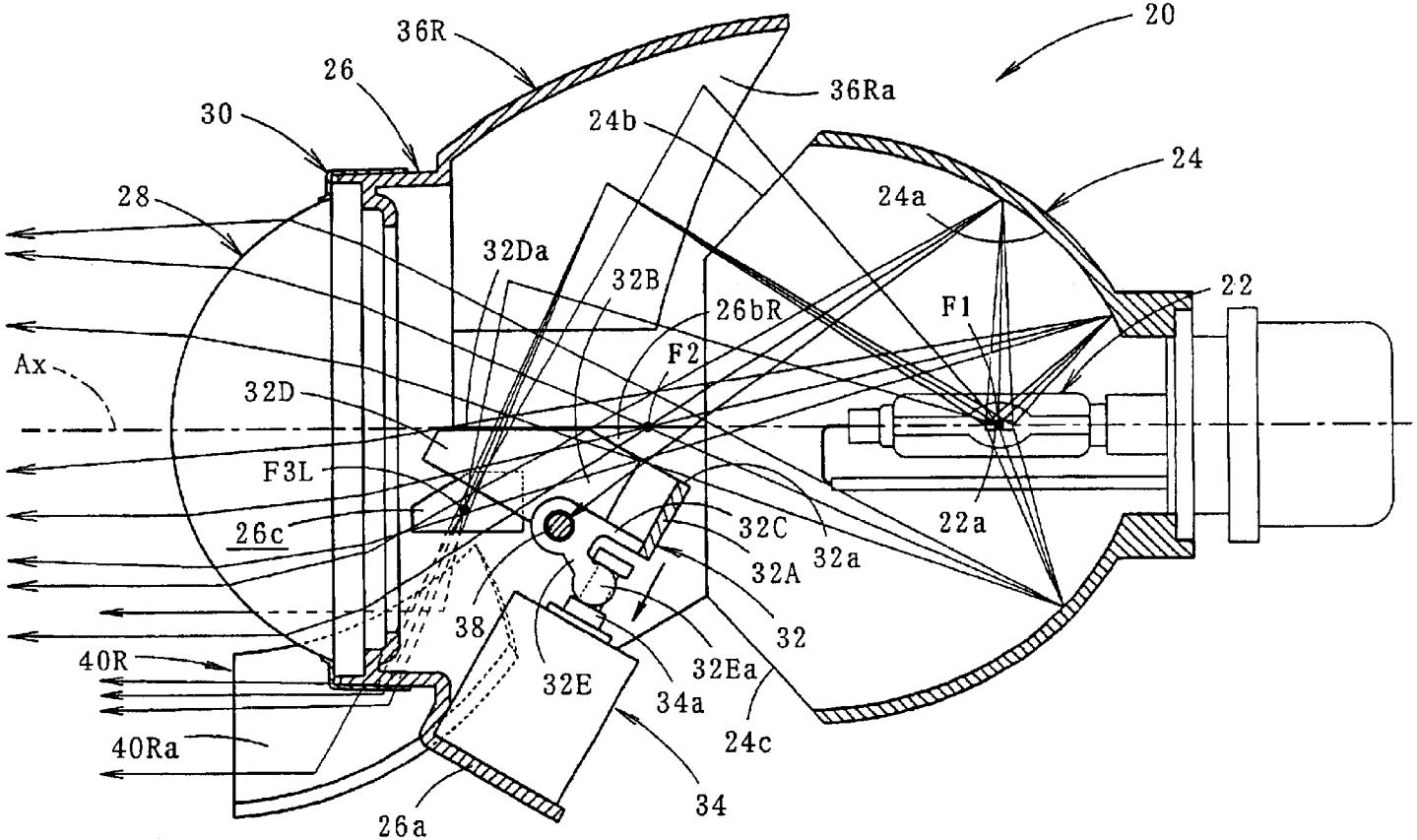
FIG. 3 is a vertical sectional view showing the lamp unit of FIG. 2.
Figure 4:
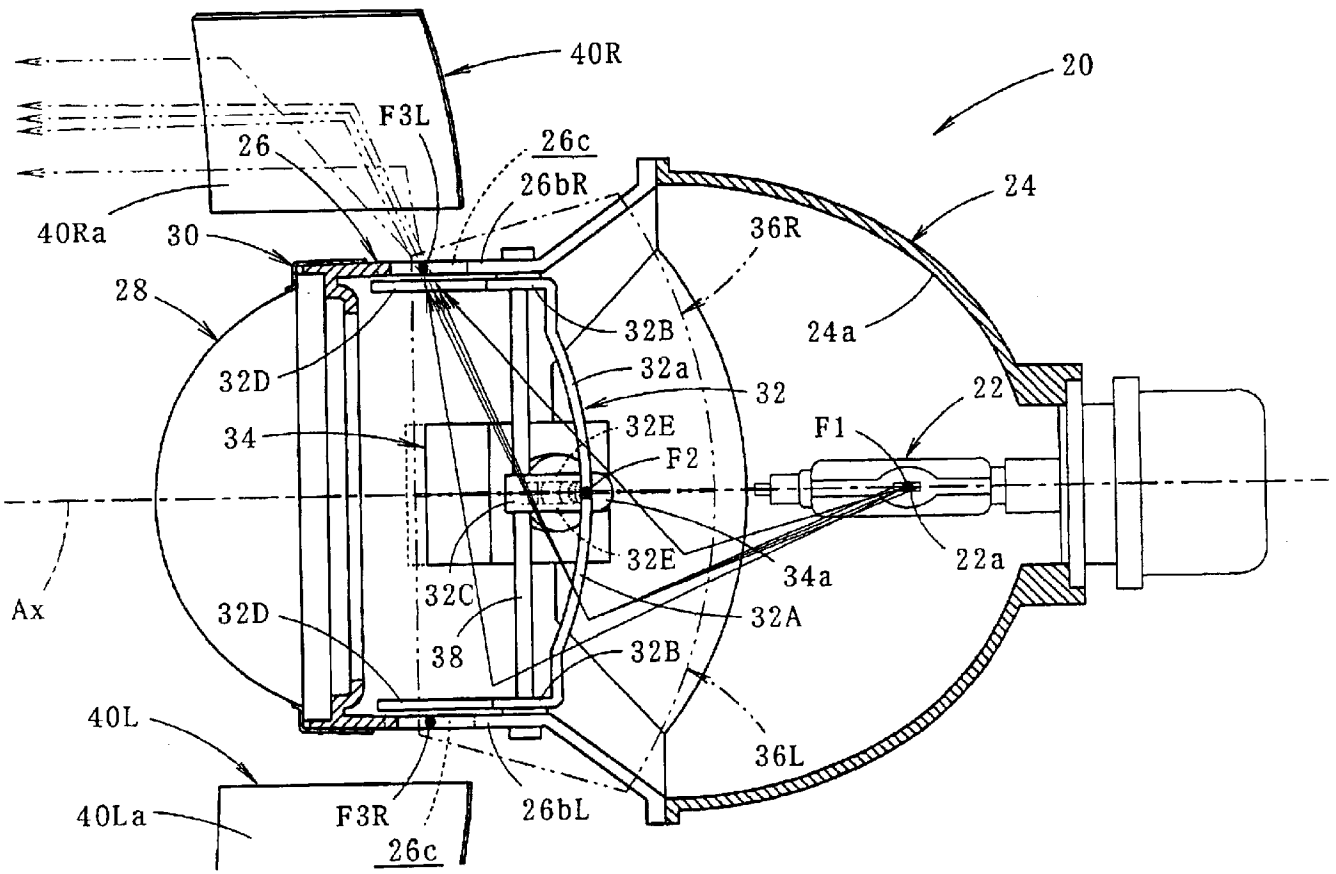
FIG. 4 is a horizontal sectional view showing the lamp unit alone.
Figure 5:
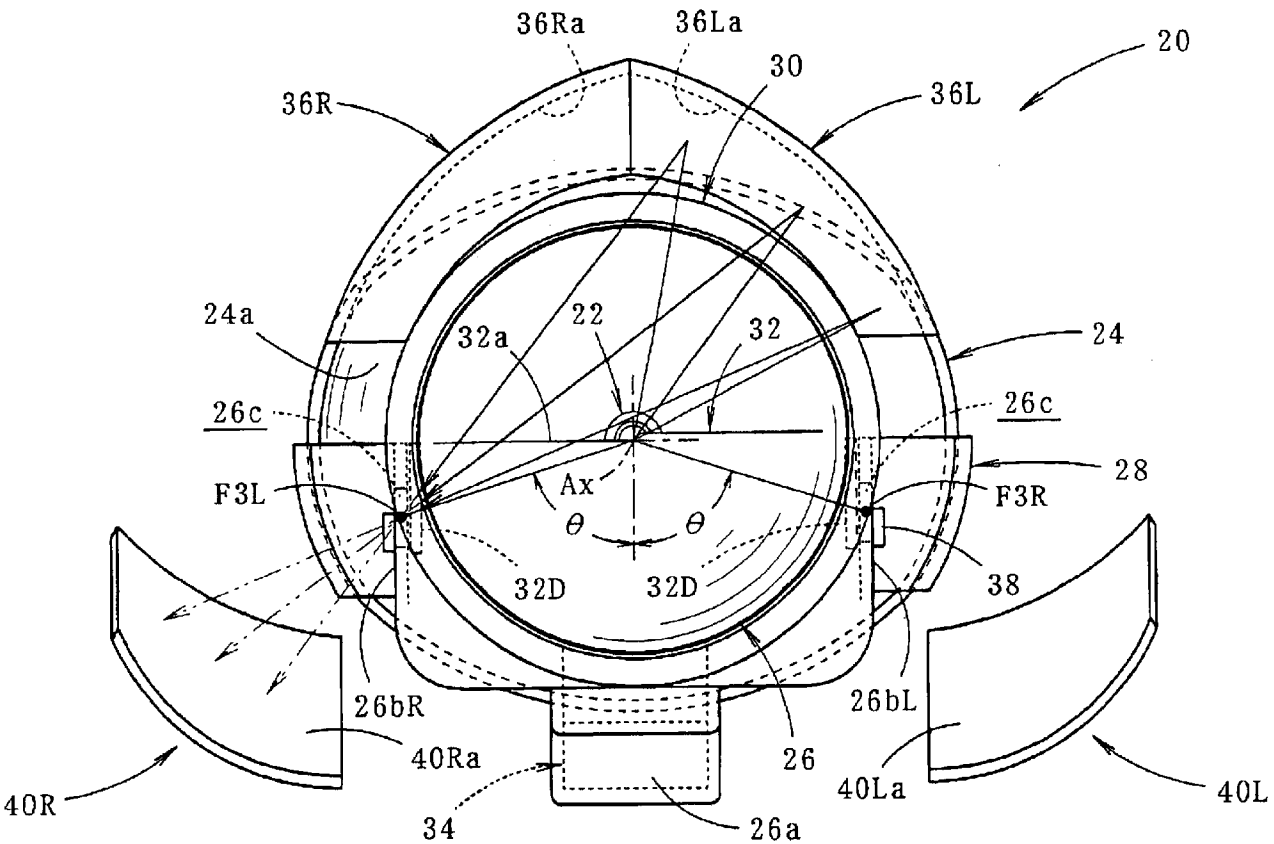
FIG. 5 is a front view showing the lamp unit alone.
Figure 6:
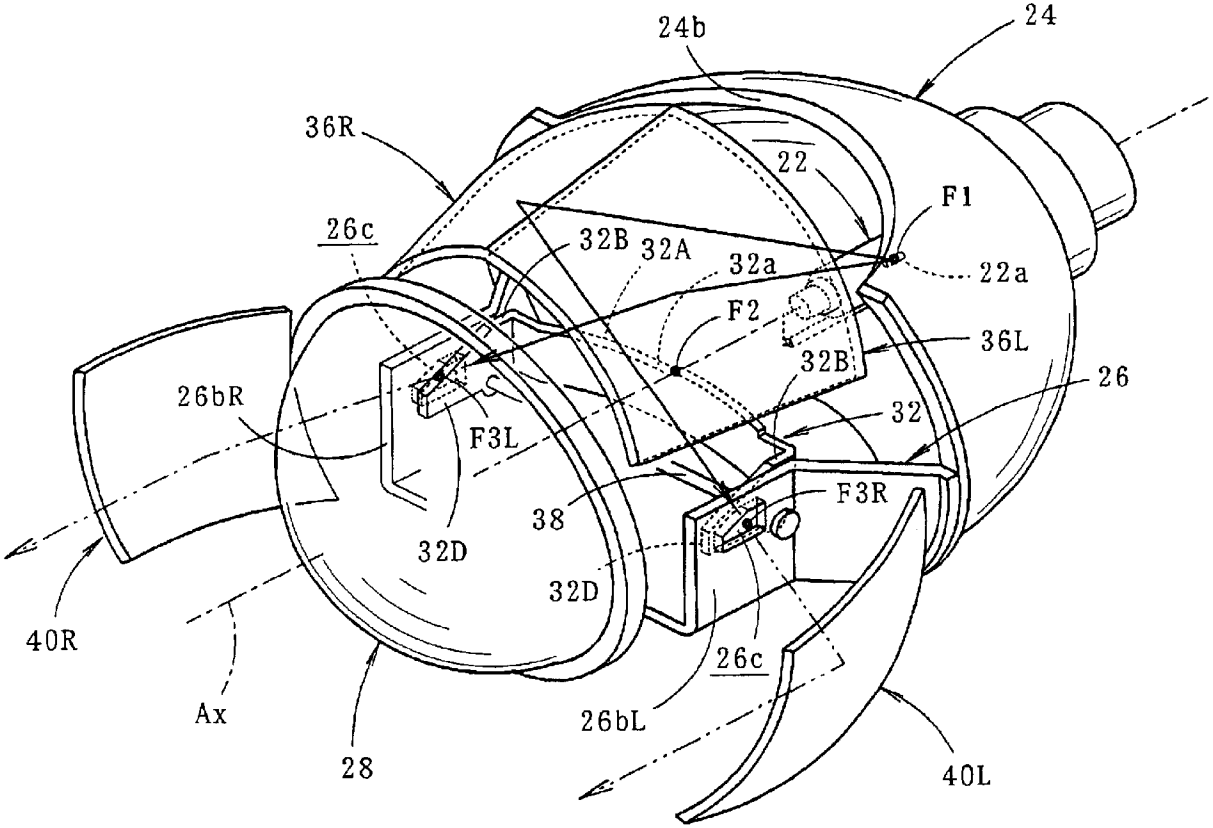
FIG. 6 is a perspective view showing main components of the lamp unit.

FIGS. 2 and 3 are vertical sectional views showing the lamp unit 20 alone, and FIGS. 4 and 5 are its horizontal sectional view and front view. Also, FIG. 6 is a perspective view showing major components of the lamp unit 20.

As shown in these figures, the lamp unit 20 is a projector-type lamp unit including a discharge bulb 22, a reflector 24, a holder 26, a projection lens 28, a shade 32, an actuator 34, first additional reflectors 36L, 36R, and second additional reflectors 40L, 40R.

In this implementation, the discharge bulb 22 is a metal halide bulb, which is mounted on the reflector 24 so that its discharging light portion 22*a* (light source) is provided coaxially with an optical axis Ax extending in the longitudinal direction of a vehicle.

The reflector 24 includes a substantially ellipsoid spherical reflective surface 24*a* of which a central axis is the optical axis Ax. With respect to the reflective surface 24*a*, a cross section including the optical axis Ax is ellipsoid-shaped, and an eccentricity is set to increase gradually from the vertical section toward the horizontal section. However, rearward apexes of the ellipsoids forming these cross sections are set at the same position. The light source 22*a* is positioned at a first focus F1 of the ellipsoid forming the vertical section of the reflective surface 24*a*. This makes the reflective surface 24*a* reflect light from the light source 22*a* forward and toward the optical axis Ax, and then the light converges to a second focus F2 of the ellipsoid in the vertical section including the optical axis Ax. Circular notched portions 24*b*, 24*c* are formed in an upper end portion and a lower end portion of a front end opening portion of the reflector 24.

The holder 26 is formed into a cylindrical shape extending forward from the front opening portion of the reflector 24, and is fixed to the reflector 24 at a rear end portion while fixing the projection lens 28 through a retaining ring in a front end portion. In the lower end portion of the holder 26, an actuator supporting part 26*a* for fixing the actuator 34 is formed. Also, in the upper end portion of the holder 26, a right and left pair of the first additional reflectors 36L, 36R are formed integrally with the holder 26 to be positioned obliquely upward of the optical axis Ax.

The first additional reflectors 36L and 36R include reflective surfaces 36La and 36Ra formed to be ellipsoid spherical, and the first focus is set at the same position as the first focus F1 of the reflector 24. Also, the second focuses F3L and F3R of the first additional reflectors 36L and 36R are set at predetermined positions (described later) below the optical axis Ax.

The projection lens 28 includes a plano-concave lens of which the front surface is concave and the rear surface is plane, and is arranged so that the rear focus position agrees with the second focus F2 of the reflector 24. Thus, the projection lens 28 converges light reflected from the reflective surface 24*a* of the reflector closer to the optical axis Ax and passes it through.

The shade 32 is provided with a circular vertical portion 32A that extends in a lateral direction, two side vertical portions 32B extending forward from right and left end portions of the circular vertical portion 32A and a center bracket 32C extending forward from the lower end portion of a center portion in lateral direction of the circular vertical portion 32A. The center bracket 32C is rotatably fixed to both side wall portions 26*b*L, 26*b*R of the holder 26 through a rotating shaft member 38 extending in a lateral direction in an internal space of the holder 26. Also, the shade 32 is rotatable about the rotating shaft member 38 between the shade position (the position shown in a solid line in FIG. 1) and the translucent position (the position shown in a chain double-dashed line in FIG. 1).

Figure 7A:
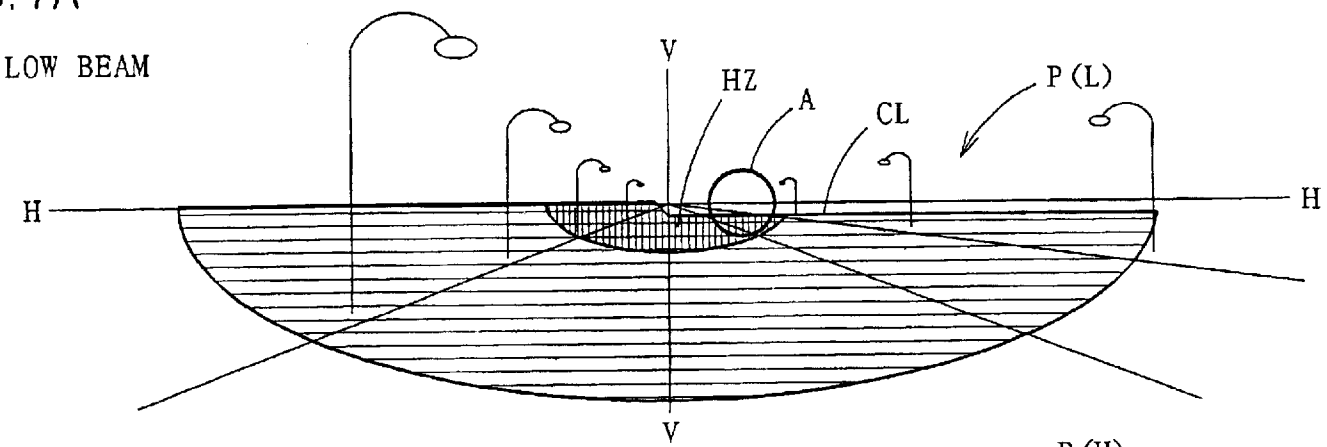
FIGS. 7A and 7B are perspective views showing a low beam and a high beam light distribution pattern, respectively, formed on a vertical screen arranged at a position 25 m in the front of the lamp unit by a beam irradiated from the lamp unit according to the invention.

When the shade 32 is in the shade position, it is arranged so that the upper edge 32*a* passes the second focus F2 in order to shade a part of light reflected from the reflective surface 24*a* and remove upward light irradiated from the lamp unit 20. Then, light for low beam (the beam shown in a solid line in FIG. 2) irradiated below with respect to the optical axis Ax is obtained. This forms a low beam distribution pattern P (L) of left light distribution having a Z-shaped cut-off line with a stepped difference between right and left, as shown in FIG. 7A.

Meanwhile, when the shade 32 is at the translucent position as shown in FIG. 3, the shade 32 releases the shielding of light reflected from the reflective surface 24*a*, and allows irradiation of upward light from the lamp unit 20. Then, irradiated light for high beam (the beam shown in a solid line in FIG. 3) is obtained. This forms a high beam distribution pattern P(H), as shown in FIG. 7B.

It should be noted that areas shown by HZ in the low beam distribution pattern P(L) and the high beam distribution pattern P(H) are hot zones (area of high-intensity light).

Figure 7B:
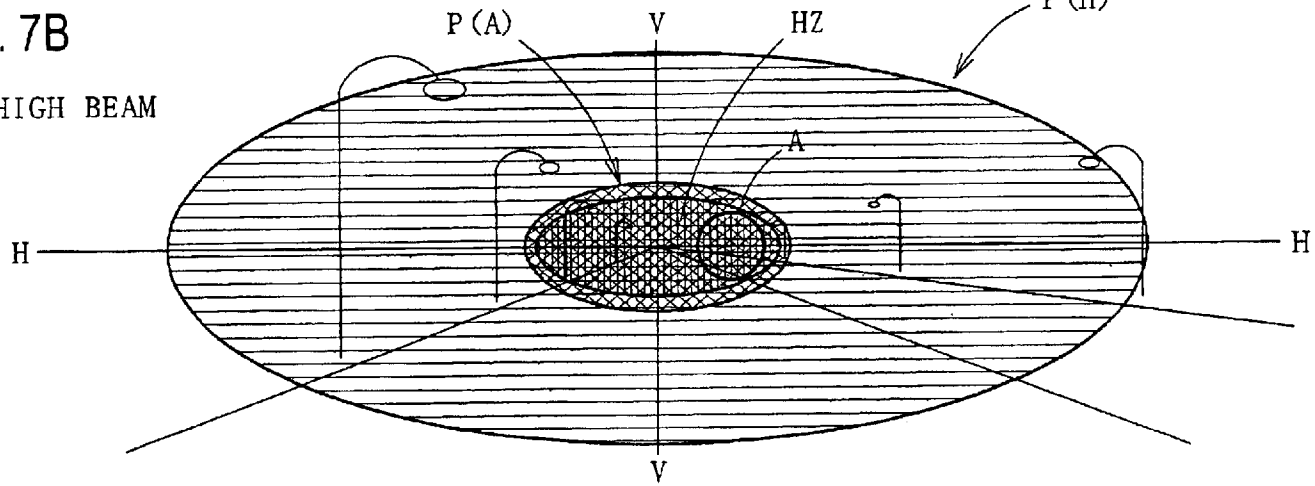

In this embodiment, when the shade 32 is at the translucent position, an additional light distribution pattern P(A) is formed in the center area of the high beam distribution pattern P(H), as shown in FIG. 7B. (This will be explained later.)

The upper edge 32*a* of the shade 32 is formed in a step-like manner (see FIG. 5) so that the right side with respect to the optical axis Ax is at the same height as the optical axis Ax and the left side is one step higher than the optical axis, in the circular vertical portion 32A. Also, the both side wall portions 26*b*L, 26*b*R of the holder 26 are formed so that the upper edges thereof are positioned at the same height as the optical axis Ax.

Both vertical portions 32B of the shade 32 are arranged in the vicinity of the interior surface of both side wall portions 26*b*L, 26*b*R of the holder 26, and trapezoidal shaped shutter pieces 32D extending forward are integrally formed with the both vertical portions 32B respectively. The shutter pieces 32D are formed so that the upper edge slant portions 32Da are at the same height as the upper edge portions of both side wall portions 26*b*L, 26*b*R of the holder 26 when the shade 32 rotates to the translucent position.

The rotating shaft member 38 of the shade 32 is supported at the lower end portion of the both vertical portions 32B as well as at the center bracket portion 32C. A right and left pair of rotating engaging pieces 32E extending obliquely down-rearward from the rotating shaft member 38 is integrally formed with the center bracket 32C. Tip portions of these rotating engaging pieces 32E are formed slightly larger, as circular tip portions 32Ea. Then, these are engaged in the actuator 34 at the pair of circular tip portions 32Ea.

The actuator 34 includes a return spring built-in solenoid fixed on the actuator supporting portion 26*a* of the holder 26 in a way that the solenoid is directed obliquely upper-rearward, and is arranged in a way that the plunger 34*a* is engaged in a pair of the rotating shaft members 32E of the shade 32. Then, the actuator 34 is activated in accordance with a change-over operation of a beam switch, which is not shown, and rotates the shade 32 between the shade position and the translucent position in order to execute switching low and high beams.

The plunger 34*a* of the actuator 34 is formed so that a portion near the tip portion thereof is a small diameter portion, and the circular tip portions 32Ea of the both rotating engaging portions 32E are engaged with the small diameter portion. Also, the actuator 34 maintains the shade 32 at the shade position using an elastic force of the built-in return spring, in a non-excitation state.

On side portions of both shutter pieces 32D in both side wall portions 26*b*L, 26*b*R of the holder 26, through-holes 26*c* are formed, respectively. Each of the through-holes 26*c* is formed one size smaller than each shutter piece 32D. The through-holes 26*c* are blocked by each shutter piece 32D when the shade 32 is in the shade position and are opened due to a rotational displacement of each shutter piece 32D when the shade 32 is in the translucent position. When through-holes 26*c* are open, the through-holes are in a pentagon shape. The second focuses F3L, F3R of the additional reflectors 36L, 36R are positioned substantially in the center of the pentagon (See FIG. 6).

Then, the second focus F3L of the left first additional reflector 36L is positioned at nearly the center of the through-hole 26*c* formed on the right wall 26*b*R of the holder 26, and the second focus F3R of the right first additional reflector 36R is positioned substantially in the center of the through-hole 26*c* formed in the left wall portion 26*b*L of the holder 26. As shown in FIG. 5, these second focuses F3L, F3R are positioned at a location where the second focuses are rotated by an angle θ (θ=approximately 70 degrees) from vertically below the optical axis Ax rightward and leftward respectively, and also approximately 30 mm horizontally distant from the optical axis Ax.

A right and left pair of the second additional reflectors 40L, 40R are fixed to the holder 26 by fixing means (not shown in FIG. 5) in an area around obliquely downwardly inclined toward both right and left sides of the holder 26. The reflective surfaces 40La, 40Ra of the second additional reflectors 40L, 40R have central axis parallel to the optical axis Ax passing through the second focuses F3R, F3L, and are provided with rotational paraboloids having focuses at the positions of the second focuses F3R, F3L.

As shown in FIGS. 4 and 5, light from the light source 22*a* is directed obliquely upward and is inclined forward and leftward from the light source 22*a* and enters the left first additional reflector 36L and is reflected by the first additional reflector 36L and converges to the second focus F3L. However, as shown in FIG. 2, the light converging to the second focus F3L does not enter the right second additional reflector 40R since the through-hole 26*c* on the right wall portion 26*b*R of the holder 26 is blocked by the shutter piece 32D when the shade 32 is in the shade position.

Meanwhile, as shown in FIG. 3, the light converging to the second focus F3L enters the right second additional reflector 40R since the through-hole 26*c* on the right wall portion 26*b*R of the holder 26 is open when the shade 32 is in the translucent position. Since the incident light enters as divergent light from the second focus F3L, the light reflected by the second additional reflector 40R is irradiated forward as parallel light.

At this time, since the second focus F3L is at a position where it is rotated approximately 70 degrees rightward from vertically below the optical axis Ax, and also approximately 30 mm horizontally distant from the optical axis Ax, it is possible to converge light reflected from the first additional reflector 36L to the second focus F3L at an approximately horizontal angle, which allows the light source image entering the second additional reflector 40R to be horizontally rectangular. Therefore, as shown in FIG. 8B, it is also possible to make a horizontally rectangular light source image IR, which is formed by light reflected from the second additional reflector 40R on a virtual vertical screen provided at the front of the lamp unit.

Also, as shown in FIG. 6, with respect to direct light from the light source 22*a* directed upward inclined forward and rightward and that enters the right first additional reflector 36R, it is as well controlled symmetrically to the direct light entering the left first additional reflector 36L. Then, the light entering the left second additional reflector 40L from the right first additional reflector 36R is reflected by the second additional reflector 40L and is formed as a light source image IL symmetrical to the light source IR on the virtual vertical screen, as shown in FIG. 8A.

Figures 8A, 8B, 8C:
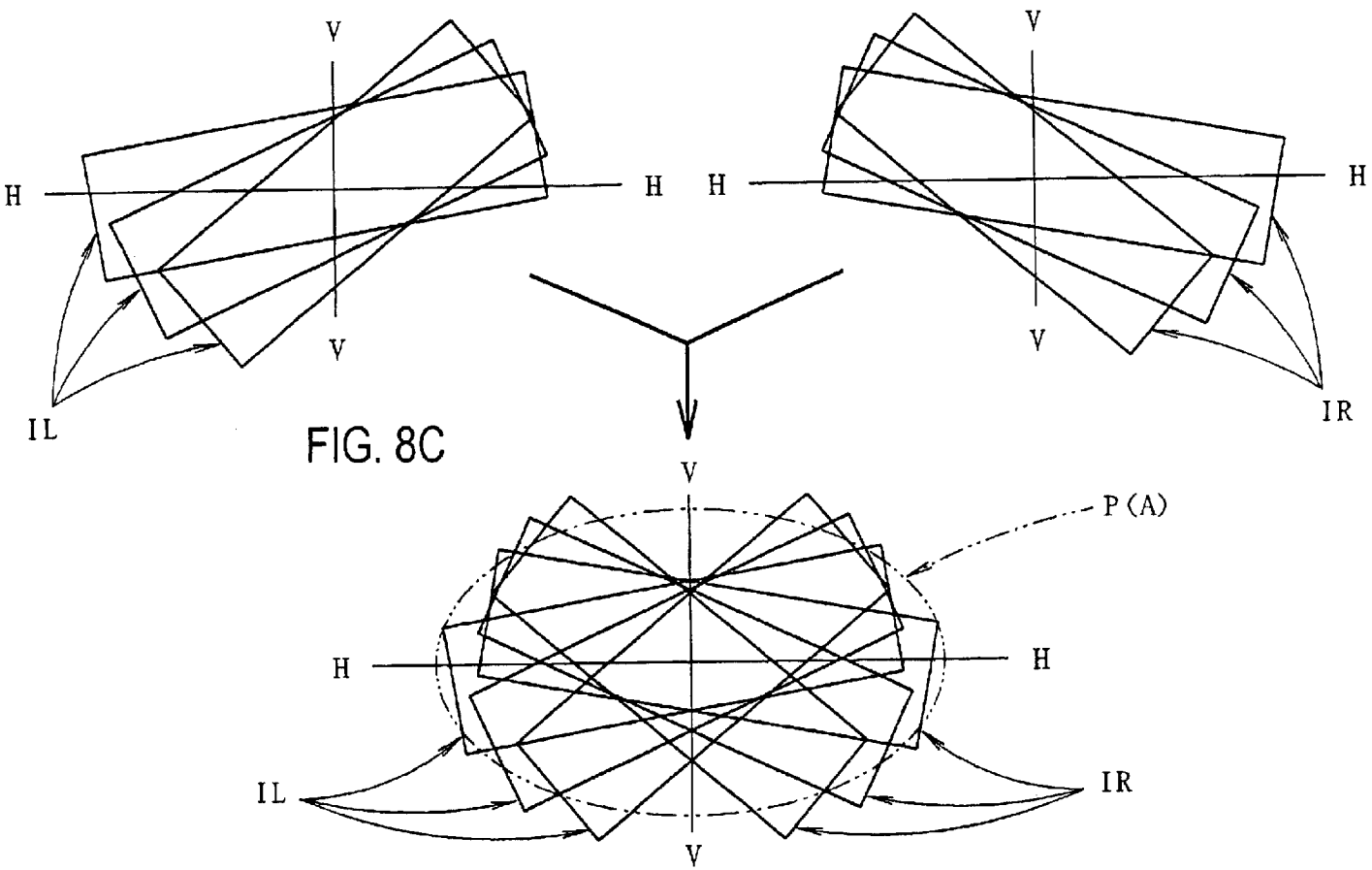
FIGS. 8A, 8B and 8C are light distribution patterns to illustrate the effects of the embodiment.
Figure 9A:
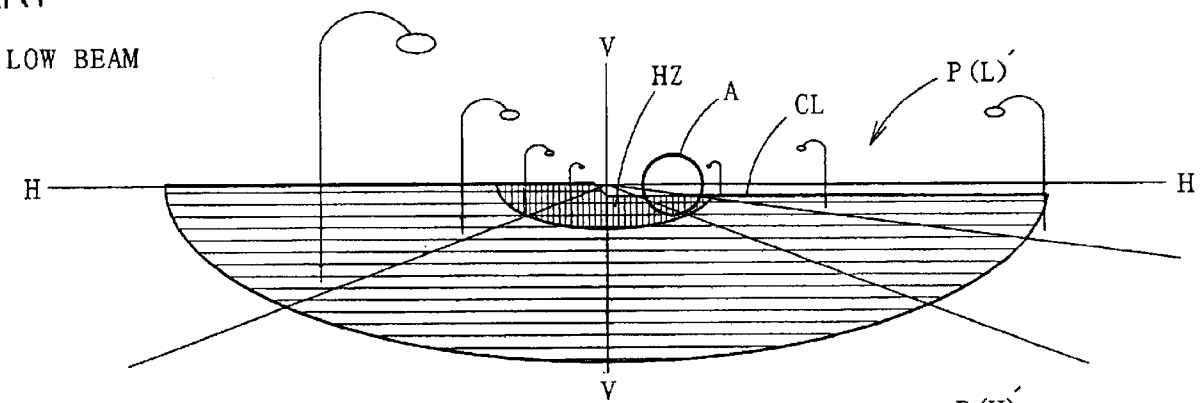
FIG. 9A PRIOR ART
FIGS. 9A and 9B show examples of conventional light distribution patterns in a low beam and a high beam mode, respectively.
Figure 9B:
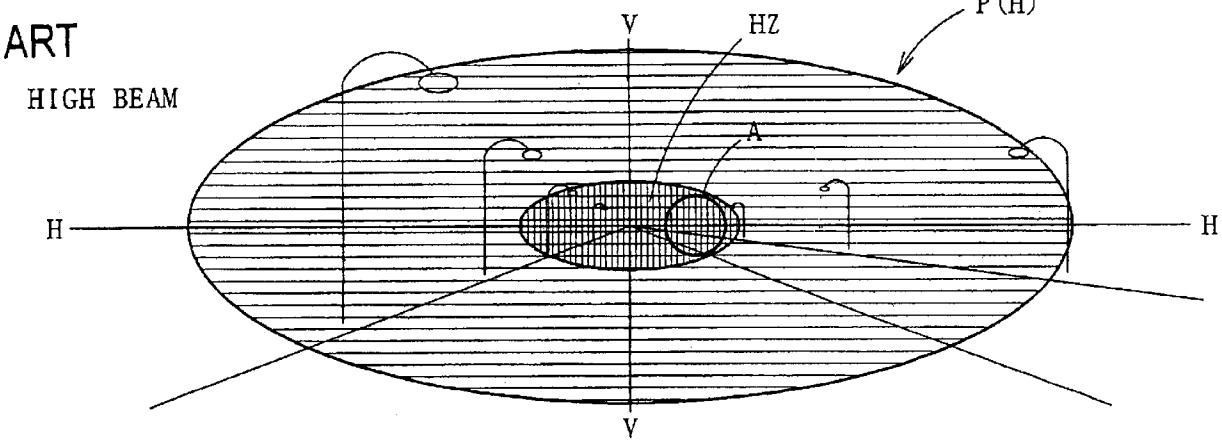
FIG. 9B PRIOR ART

Also, as shown in FIG. 8C, an additional light distribution pattern P(A) is formed as an envelope form of a light source image, formed by synthesizing these two pairs of the light source image IR and the light source image EL of FIGS. 8A and 8B, and this additional light distribution pattern P(A) is additionally formed in the center area of the high beam distribution pattern P(H), as shown in FIG. 7B. Since both the light source image IR and the light source image IL are then formed in a symmetrical shape as horizontally rectangular images, the additional light distribution pattern P(A), which is formed as its envelope form, also becomes a symmetrically formed pattern with a vertically narrow width.

Effects of the embodiments will be explained below.

At the time of low beam irradiation, the additional light distribution pattern P(A) is not formed, and only the low bean light distribution pattern P(L), the basic light distribution pattern, is formed as shown in FIG. 7A. In this case, the low beam distribution pattern P(L) is formed at a luminous intensity distribution pattern in which a luminosity of the zone A in the vicinity of the cut-off line CL in the opposite lane does not become more than necessary, but the luminosity of the zone A in the hot zone HZ in the high beam distribution pattern P(H) may not be adequately ensured.

In this regard, in the embodiment, since the additional light distribution pattern P(A) is superimposed on the high beam distribution pattern P(H), the luminosity of the zone A is adequately ensured even if the luminosity of the hot zone HZ in the high beam distribution pattern P(H) is not significantly high. Also, in the embodiment, since the additional light distribution pattern P(A) is formed as a pattern with a narrow vertical width, it is possible to enhance the luminosity of the hot zone HZ while making the short distance area on the road at the front of the vehicle not excessively luminous.

According to the embodiment, as mentioned above, it is possible to efficiently enhance the luminosity of the hot zone HZ in the high beam distribution pattern P(H) in addition to preventing glare at the oncoming driver, in the low beam distribution pattern P(L).

Particularly in the embodiment, since the additional light distribution pattern P(A) is formed by the two pairs of the additional first reflectors 36L, 36R, and the second reflectors

40R, 40L, which are arranged symmetrically with respect to the optical axis Ax, the additional light distribution pattern P(A) can be symmetrically formed with high luminous intensity. This makes it possible to enhance the luminosity of the hot zone HZ more efficiently at the time of high beam irradiation, Also, in the embodiment, as direct light from the light source 22*a* is directed obliquely front-upward, which is not commonly used for forming a light distribution pattern in the projector-type lamp unit, is used for forming the additional light distribution pattern, the additional light distribution pattern P(A) can be formed without adversely affecting the formation of the basic light distribution pattern, the formation of the low beam distribution pattern P(L) and the high beam distribution pattern P(H).

In the embodiment, the shade 32 is rotatable so that the shade 32 can take the shade position where light reflected from the reflector is partly shielded, and the shade can take the translucent position where the light shielding is released. The shade is configured to shield light directed to the second additional reflectors 40R, 40L from the first reflectors 36L, 36R when it is at the shade position as well as to release the shielding of light directed to the second additional reflectors 40R, 40L from the first additional reflectors 36L, 36R when it is at the translucent position. Therefore, beam irradiation can be executed only in the low beam distribution pattern P(L), the basic light distribution pattern, at the time of low beam irradiation. In addition, the additional light distribution pattern P(A) can be added to the high beam distribution pattern P(H), the basic light distribution pattern, at the time of high beam irradiation, without requiring a new apparatus.

A pair of the through-holes 26*c* formed on both side wall portions 26*b*L, 26*b*R of the holder 26 are blocked when the shade 32 is at the shade position, and are opened when the shade is at the translucent position by a pair of the shutter pieces 32D formed on the both vertical portions 32B of the shade 32. This makes it possible to execute blocking and release blocking of light directed to the second additional reflectors 40R, 40L from the first additional reflectors 36L, 36R, and to prevent stray light in the lamp unit 20 from entering the second reflectors 40R, 40L through the through-holes 26*c* at the time of low beam irradiation.

Also, in the embodiment, since the second focuses F3L, F3R are arranged at the position where each of them is rotated approximately 70 degrees rightward or leftward from vertically below the optical axis Ax, and also approximately 30 mm horizontally distant from the optical axis Ax, it is possible to make the light source image entering the second additional reflectors 40R, 40L horizontally rectangular. It is also possible to make the second reflectors 40R, 40L compact without keeping excessive distance from the optical axis Ax.

It should be noted that since each shutter piece 32D is formed so that the upper end slant surface portion 32Da is approximately at the same height as the upper edge portions of the both side wall portions 26*b*L, 26*b*R of the holder 26, when the shade 32 is rotated to the translucent position, the possibility that light reflected from the reflector 24 is partly shielded by each shutter piece 32D at the time if high beam irradiation can be eliminated.

Also, in the embodiment, since the actuator 34 for driving the shade 32 is provided between the right and left pair of the second additional reflectors 40R, 40L, the space below the optical axis can be efficiently utilized, which makes it possible to form a compact lamp unit.

In the embodiment, since the reflective surfaces 40Ra, 40La of the second additional reflectors 40R, 40L include rotational paraboloids of which the focuses are at the positions of the second focuses F3L, F3R of the first additional reflectors 36L, 36R, it is possible to form the additional light distribution pattern P(A) with high luminous intensity by parallel reflected light. However, if it is not specifically required to enhance the luminous intensity of the hot zone HZ, it is also possible to form the reflective surface 40Ra, 40La by diffusing reflective surfaces, or the like, which diffuse and reflect light from the first additional reflectors 36L, 36R in a lateral direction, instead of by rotational paraboloids.

Also, in the embodiment, as has been explained, the second focuses F3L, F3R of the first additional reflectors 36L, 36R are provided at the positions where each second focus is rotated by an angle θ (θ=approximately 70 degrees) leftward and rightward from vertically below the optical axis Ax, and also approximately 30 mm horizontally distant from the optical axis Ax. However, if the second focuses are positioned on the side of the second additional reflectors 40R, 40L with respect to the optical axis Ax, the approximate same effects as the embodiment can be obtained even when a value other than this is set. At this time, it is preferable to set the angle θ at 45 degrees or more in order to make the additional light distribution pattern P(A) into a pattern with an adequately narrow vertical width. In addition, it is preferable to set the distance between the second focuses F3L, F3R, and the optical axis Ax at 20 mm or more in order to form compact second additional reflectors 40R, 40L without keeping excessive distance from the optical axis Ax.

What is claimed is:

1. A vehicle headlamp which is configured to execute beam irradiation forward in a predetermined light distribution pattern by means of a projector-type lamp unit comprising:

a light source provided on an optical axis extending in a longitudinal direction of a vehicle;

a reflector which reflects light from the light source forward and toward the optical axis;

a projection lens provided at the front of the reflector;

a shade provided between the projection lens and the reflector and partly shields light reflected from the reflector; and a first additional reflector which reflects direct light from the light source obliquely downward along the optical axis, the first additional reflector provided between the reflector located obliquely upward of the optical axis and the projection lens; and a second additional reflector which reflects light reflected from the first additional reflector forward, the second additional reflector provided obliquely downward of the optical axis, which is diagonally opposite to the first additional reflector;

wherein a reflective surface of the first additional reflector is formed as an ellipsoid spherical surface having a first focus in the vicinity of the light source and a second focus on the second additional reflector side with respect to a vertical plane including the optical axis.

2. The vehicle headlamp according to claim 1, wherein the shade is movable so that the shade can take a shade position where light reflected from the reflector is partly shielded and a translucent position where the light shielding is released, and the shade is also configured such that when the shade is at the shade position, the shade shields light directed from the first additional reflector to the second additional reflector, and when the shade is at the translucent position, the shade releases the shielding of light directed from the first additional reflector to the second additional reflector.

3. The vehicle headlamp according to claim 2, further comprising:

a fixed member provided in the vicinity of the second focus which includes through-holes that pass light directed from the first additional reflector to the second additional reflector; and a shutter piece formed on the shade for blocking the through-holes when the shade is at the shade position, and for opening the through-holes when the shade is at the translucent position.

4. The vehicle headlamp according to either claim 2 or 3, further comprising an actuator provided on the optical axis side with respect to the second additional reflector for driving the shade.

5. The vehicle headlamp according to claim 1 further comprising two pairs of the first and the second additional reflectors provided on both right and left sides with respect to the optical axis.

6. The apparatus of claim 1 wherein the first additional reflector reflects light obliquely downward in a forward direction away from the light source and toward the second additional reflector.

7. The apparatus of claim 1 wherein the second additional reflector is located at a position that is closer to the projection lens than the first additional reflector.

8. A lamp unit for a vehicle headlamp comprising:

a light source;

a reflector that reflects light from the light source forward toward an optical axis;

a lens connected at a front portion of the reflector;

a movable shade provided between the lens and the reflector;

a first additional reflector located obliquely above the optical axis, for reflecting light obliquely downward along the optical axis; and a second additional reflector located obliquely below the optical axis and diagonally across from the first additional reflector, for reflecting light from the first additional reflector in a forward direction.

9. The apparatus of claim 8 wherein the first additional reflector has an ellipsoidal spherical surface with a first focus in the vicinity of the light source and a second focus on the side of the second additional reflector.

10. The apparatus of claim 8 wherein the movable shade has a shade position in which light from the first additional reflector is shaded from the second additional reflector, and has a translucent position wherein light from the first additional reflector passes to the second additional reflector.

11. The apparatus of claim 8 further comprising a fixed member in the vicinity of the second focus including through holes, and a shutter capable of blocking the through holes.

12. The apparatus of claim 8 further comprising an actuator for driving the shade.

13. The apparatus of claim 8 further comprising a second pair of the first and second additional reflectors.

* * * * *